US006273784B1

(12) United States Patent
Yamazaki et al.

(10) Patent No.: US 6,273,784 B1
(45) Date of Patent: Aug. 14, 2001

(54) SURFACE TREATMENT METHOD AND APPARATUS FOR SUPPORT OF LITHOGRAPHIC PLATE

(75) Inventors: Toru Yamazaki; Yuzo Rachi, both of Shizuoka (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/207,664

(22) Filed: Dec. 9, 1998

(30) Foreign Application Priority Data

Dec. 12, 1997 (JP) ..... 9-343248

(51) Int. Cl.[7] ..... B24B 1/00

(52) U.S. Cl. ..... 451/10; 451/11; 451/36; 451/59; 451/109; 451/124; 451/184; 451/213; 451/137

(58) Field of Search ..... 451/81, 109, 120, 451/124, 184, 336, 907, 167, 213, 214, 136, 137, 10, 11, 25, 36, 59

(56) References Cited

U.S. PATENT DOCUMENTS 2,702,969 * 3/1955 Klaar ..... 451/109
3,548,435 * 12/1970 Comber et al. ..... 451/109
4,078,905 * 3/1978 Oya ..... 451/184
4,477,317 10/1984 Chu et al. ..... 204/33
4,646,479 * 3/1987 Walker et al. ..... 451/124
5,759,089 * 6/1998 McCoy ..... 451/184

FOREIGN PATENT DOCUMENTS 53-123204 10/1978 (JP) ..... B41N/3/00

* cited by examiner

*Primary Examiner*—Eileen P. Morgan
(74) *Attorney, Agent, or Firm*—Sughrue, Mion, Zinn, Macpeak & Seas, PLLC

(57) ABSTRACT

There is provided at least one of a moving device for moving a graining brush in the width direction of aluminum web and a turning device for turning the graining brush so that the graining brush can be placed obliquely against a transporting direction of the aluminum web. By moving the graining brush periodically in the width direction of the aluminum web, the entire graining brush uniformly comes into contact with the aluminum web. By turning the graining brush to place it obliquely against the transporting direction of the aluminum web, the entire graining brush can always come into contact with the aluminum web. Accordingly, the abrasion in the bristles of the graining brush is maintained uniform.

5 Claims, 6 Drawing Sheets

SURFACE TREATMENT METHOD AND APPARATUS FOR SUPPORT OF LITHOGRAPHIC PLATE

BACKGROUND OF THE INVENTION

1. Field of the Invention

The present invention relates generally to method and apparatus for treating the surface of a support of a lithographic plate, and more particularly to reducing the abrasion of a graining brush that grains the surface of an aluminum support of the lithographic plate.

2. Description of Related Art

The aluminum plate has widely been used as the support of a photosensitive printing plate or the lithographic plate. The surface of the aluminum support is grained in order to improve the adherence between a sensitive layer and the aluminum support and to provide non-image parts on the plate with the capacity to retain moisture.

Japanese Patent Provisional Publication No. 53-123204 discloses a brush graining method, which is now widely used as the surface treatment method for graining the surface of the aluminum support. In the brush graining method, a graining brush, which is made of a material such as nylon, rubs the surface of the aluminum support with abrasive slurry, which contains abrasive particles of materials such as pumice or pumicite, aluminum hydroxide, or alumina, which have new Mohs'scale of 2 or more. According to the brush graining method, it is possible to sequentially obtain the support that has a good printing performance, and the equipment costs can be relatively low. U.S. Pat. No. 4,477,317 discloses the brush graining method in which the graining brush oscillates while it rotates.

The widths of aluminum webs to be the aluminum supports are not uniform, and one graining brush must continuously rubs the surfaces of the narrow aluminum web and the wide aluminum web. However, according to the surface treatment apparatus of Japanese Patent Provisional Publication No. 53-123204 and U.S. Pat. No. 4,477,317, the bristles of the graining brush are abraded sectionally if the surfaces of the aluminum webs with different widths are grained with the one graining brush continuously. Hence, the graining brush must be replaced by a new one frequently, or the bristles of the graining brush must be trimmed frequently in accordance with the abrasion, and therefore, the surface graining is neither economical nor efficient.

Specifically, since the bristles are abraded at the central part of the graining brush, with which the aluminum webs come into contact, the aluminum webs with different widths must be transported to the surface treatment apparatus sequentially in order of the width of them. Consequently, the bristles become short at the central part of the used graining brush and become relatively long at both ends thereof. To treat the surface of the wide aluminum web again, the graining brush must be replaced by a new one, or the bristles of the graining brush must be trimmed so that they can be uniform length at the central part and both ends of the graining brush.

SUMMARY OF THE INVENTION

This invention has been developed in view of the above-described circumstances, and has as its object the provision of an economical and efficient surface treatment method and apparatus for the support of the lithographic plate that decreases the number of times the graining brushes are changed and this eliminates the necessity for trimming the bristles when the surfaces of a plurality of aluminum webs with different widths are treated.

To achieve the above-mentioned object, the present invention is directed to a surface treatment method for a support of a lithographic plate, wherein a graining brush rubs a surface of the support with abrasive slurry to thereby grain the surface of the support, the surface treatment method comprising at least one the steps of: moving at least one of the graining brush and the support periodically in a direction perpendicular to a transporting direction of the support, thereby making the entire graining brush uniformly come into contact with the support; and turning at least one of the graining brush and the transporting direction of the support such that the graining brush is placed obliquely against the transporting direction of the support, thereby making the entire graining brush come into contact with the support.

Furthermore, to achieve the above-mentioned object, the present invention is directed to a surface treatment apparatus for rubbing a surface of a support of a lithographic plate by a graining brush with abrasive slurry to thereby grain the surface of the support, the surface treatment apparatus comprising at least one of: a moving device for moving the graining brush in a direction perpendicular to a transporting direction of the support; and a turning device for turning the graining brush such that the graining brush is placed obliquely against the transporting direction of the support.

According to the present invention, at least one of the graining brush and the support of the lithographic plate is moved periodically in the width direction of the support of the lithographic plate, or at least one of the graining brush and the transporting direction of the support of the lithographic plate is turned so that the graining brush can be placed obliquely against the transporting direction of the support of the lithographic plate. Thus, the entire graining brush uniformly or always comes into contact with the support of the lithographic plate. For this reason, the abrasion in the bristles of the graining brush is maintained uniform.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

This invention will be described in further detail by way of example with reference to the accompanying drawings.

Figure 1:
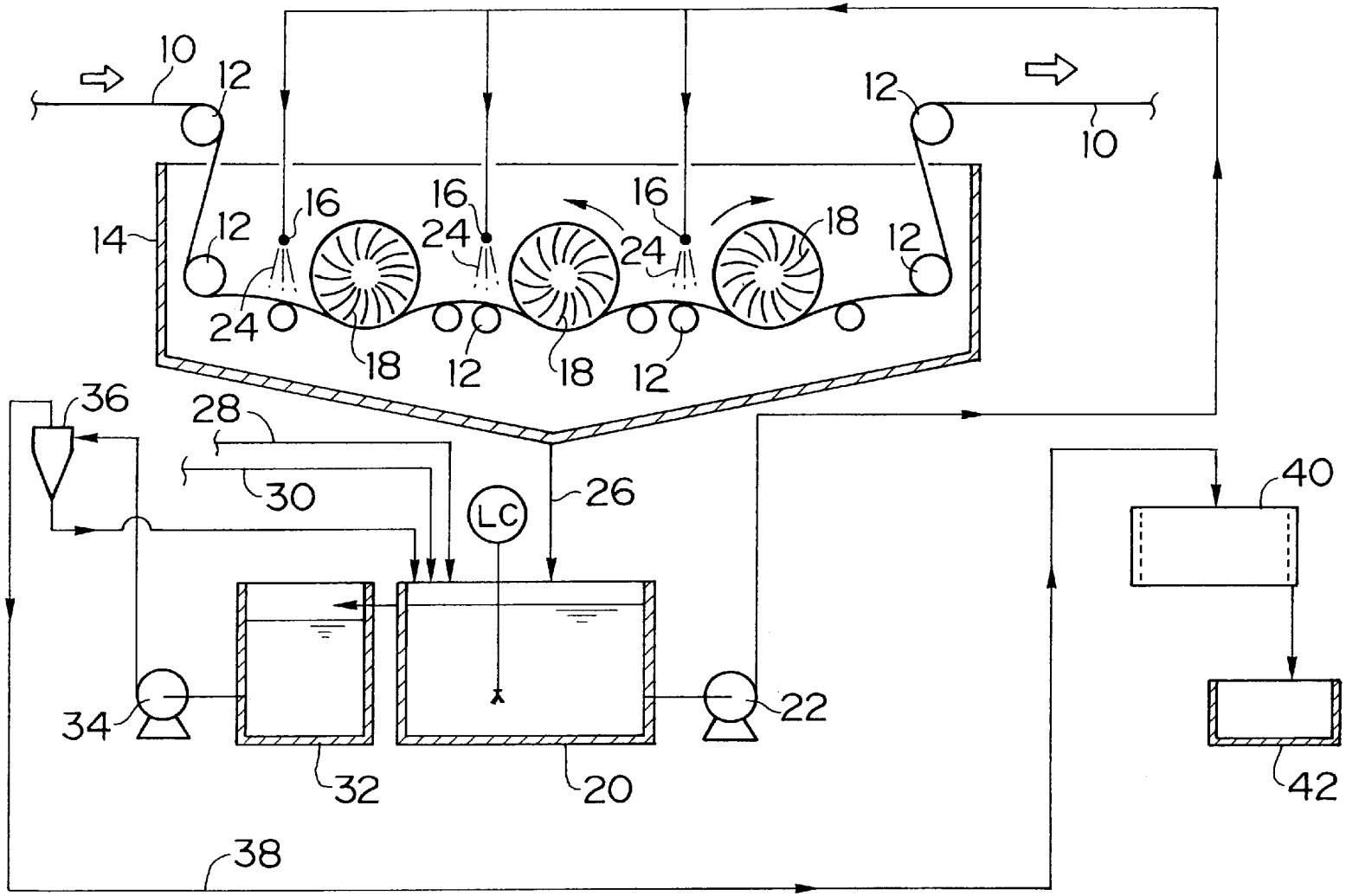
FIG. 1 is a view illustrating the overall flow of aluminum web in a surface treatment apparatus according to the present invention.

FIG. 1 is a view illustrating the overall flow of aluminum web, to be supports of lithographic plates, in a surface treatment apparatus according to the present invention.

The aluminum web 10 is transported on pass rollers 12 to a graining vessel 14. Pairs of a nozzle 16 and a brushing device 18 are arranged along a transporting route of the web 10. Abrasive slurry 24 is supplied from a circulatory tank 20 to the nozzles 16 via a circulatory pump 22. The abrasive slurry 24 is poured onto the surface of the web 10 at the upstream sides of the brushing devices 18. The brushing devices 18 rub the surface of the web 10 to which the abrasive slurry 24 adheres, so that the surface of the web 10 can be treated. Thus, the grains are formed on the surface of the web 10, and the surface of the web 10 can be rough.

The abrasive slurry 24 that has fallen into the graining vessel 14 from the web 10 returns to the circulatory tank 20 via a return line 26. The spent abrasive slurry 24, in which abrasive particles have become smaller, loses in ability to treat the surface of the web 10. To solve this problem, new abrasive particles are supplied to the circulatory tank 20 from an abrasive particle supply line 28, and water is supplied to the circulatory tank 20 from a water supply line 30. Then, the abrasive slurry 24 partially flows into an overflow tank 32. The abrasive slurry 24 in the overflow tank 32 is transferred to a cyclone 36 via a cyclone pump 34, and the abrasive particles are classified by diameter. The abrasive slurry including larger abrasive particles is returned to the circulatory tank 20, and the abrasive slurry including smaller abrasive particles is discharged from the apparatus via a discharge line 38. A centrifugal separator 40 solid-liquid separates the discharged abrasive slurry. The smaller abrasive particles are collected in a treatment tank 42, and then they are thrown away.

A description will be given of the brushing device 18.

Figure 2:
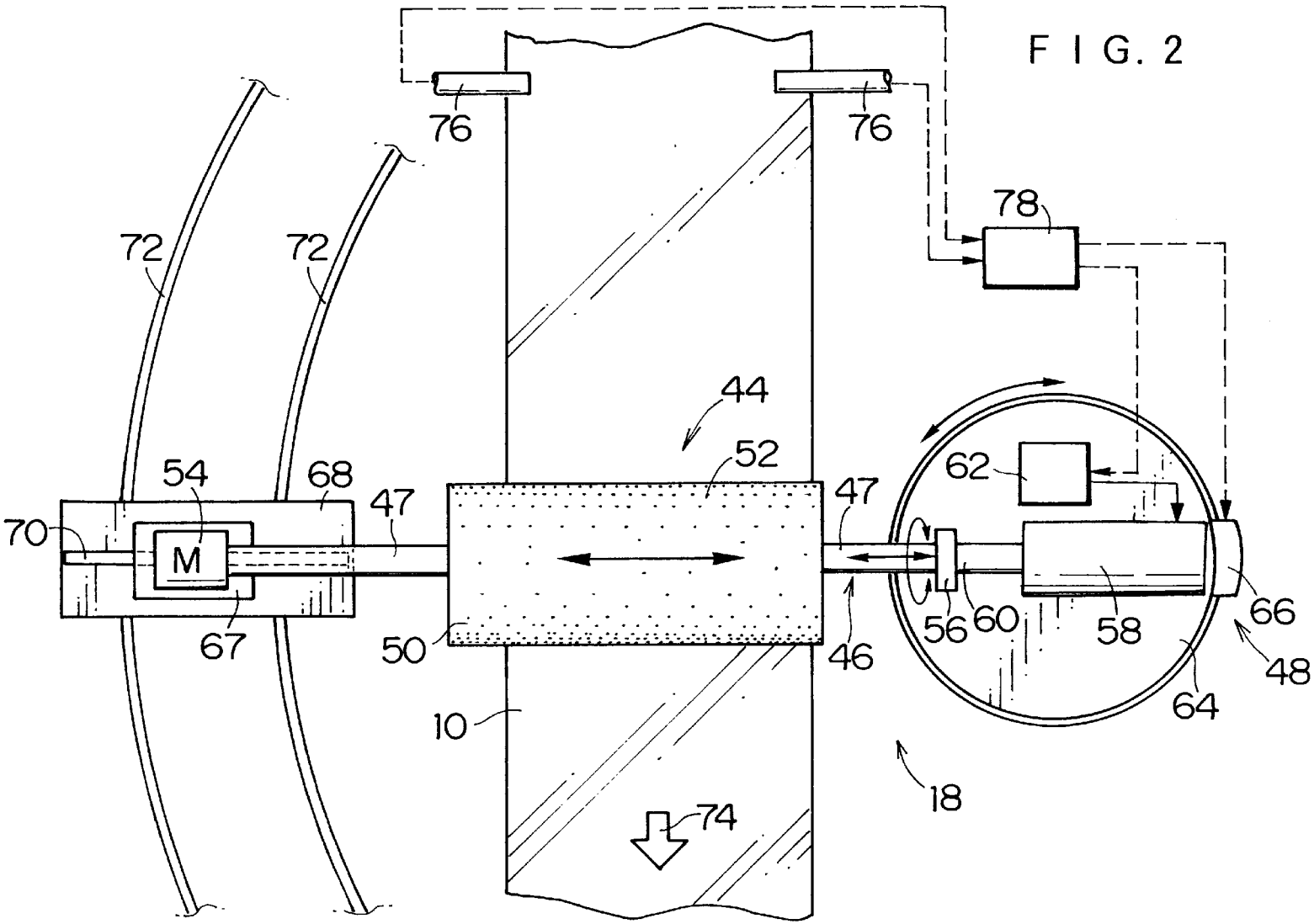
FIG. 2 is a view of assistance in explaining a brushing device of the surface treatment apparatus according to the present invention.

FIG. 2 illustrates the structure of the brushing device 18. The brushing device 18 comprises: a graining brush 44; a moving device 46 that moves the graining brush 44 periodically in a direction perpendicular to a direction 74 in which the aluminum web 10 is transported; and a turning device 48 that turns the graining brush 44 so as to place the graining brush 44 obliquely against the transporting direction 74.

The graining brush 44 comprises a roller 50 provided with a rotary shaft 47, and a number of bristles 52 provided on the periphery of the roller 50. The width of the graining brush 44 is determined in conformity with the maximum width of the aluminum web 10, which has different widths. The bristles 52 may be directly secured to the roller 50, but it is more convenient if the bristles 52 are planted on a number of channels provided on a cylindrical drum (not illustrated) and the drum is detachably attached on the roller 50.

One end of the rotary shaft 47 of the graining brush 44 connects to a motor 54, and the other end of the rotary shaft 47 connects to a piston rod 60 of a cylinder 58 through a bearing 56. A hydraulic pump 62 expands and contracts the piston rod 60. The bearing 56, the cylinder 58 and the hydraulic pump 62 are arranged on a turntable 64, which is rotated by a rotational driving part 66. On the other hand, the motor 54 is provided on a slide table 67, which is supported in such a way as to slide on a straight movement rail 70 provided on a orbitary table 68. The orbitary table 68 is supported in such a way as to slide on a pair of orbital rails 72 arranged on circles concentric with the turntable 64. The straight movement rail 70 is arranged on the orbitary table 68 in the radial direction of the turntable 64. When the hydraulic pump 62 is actuated to expand or contract the piston rod 60, the graining brush 44 moves periodically in the radial direction of the turntable 64. When the rotational driving part 66 is actuated, the graining brush 44 is turned with the turntable 64, and the graining brush 44 is placed obliquely against the transporting direction 74.

A pair of sensors 76 is provided in proximity to both ends of the aluminum web 10 along the width thereof. The pair of sensors 76 determines the positions of both ends of the aluminum web 10, and the determination values are sent to a controller 78. From the values sent from the sensors 76, the controller 78 calculates a positional relationship between the graining brush 44 and the aluminum web 10, the width of the aluminum web 10, and a difference between the graining brush 44 and the aluminum web 10 in width. From the calculated data, the controller 78 further calculates the movement amount and conditions of the piston rod 60, which moves the graining brush 44 periodically in the radial direction of the turntable 64, and the rotational amount and conditions of the turntable 64, which places the graining brush 44 obliquely against the transporting direction 74. The controller 78 drives at least one of the hydraulic pump 62 and the rotational driving part 66 in accordance with the calculated data. Thus, the graining brush 44 performs at least one of the following: moving periodically in the radial direction of the turntable 64, including the direction perpendicular to the transporting direction 74, and turning to locate obliquely against the transporting direction 74.

A description will be given of the operation of the surface treatment apparatus, which is constructed in the above-mentioned manner FIGS. 3(*a*) and 3(*b*) describe the case wherein the graining brush 44 is moved periodically in the direction perpendicular to the transporting direction 74 while treating the surface of the aluminum web 10 that is a little shorter in width than the graining brush 44. FIGS. 4(*a*) and 4(*b*) describe the case wherein the graining brush 44 is moved periodically in the direction perpendicular to the transporting direction 74 while treating the surface of the aluminum web 10 that is half of the graining brush 44 in width. In these cases, the controller 78 calculates the movement amount and conditions for moving the graining brush 44 in the direction perpendicular to the transporting direction 74 periodically in accordance with the determined values sent from the pair of sensors 76. The controller 78 actuates the hydraulic pump 62 under the calculated conditions.

Figure 3:
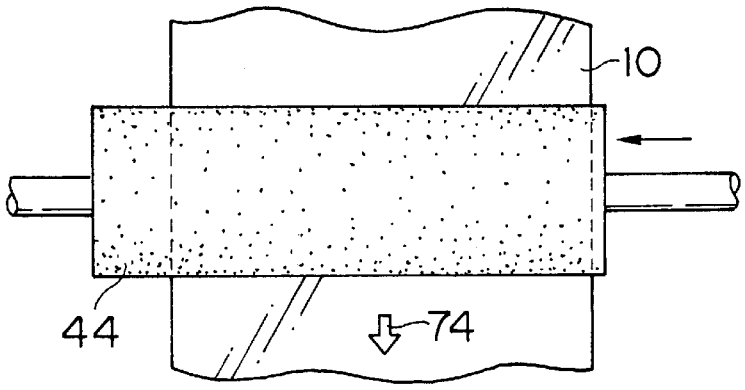
FIGS. 3(*a*) and 3(*b*) are views of assistance in explaining the operation of the surface treatment apparatus according to the present invention when the graining brush is moved in the width direction of a wide aluminum web.
Figure 3:
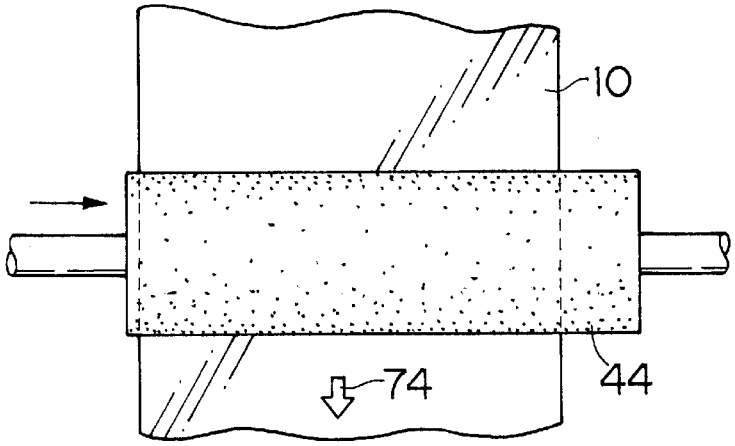
Figure 4:
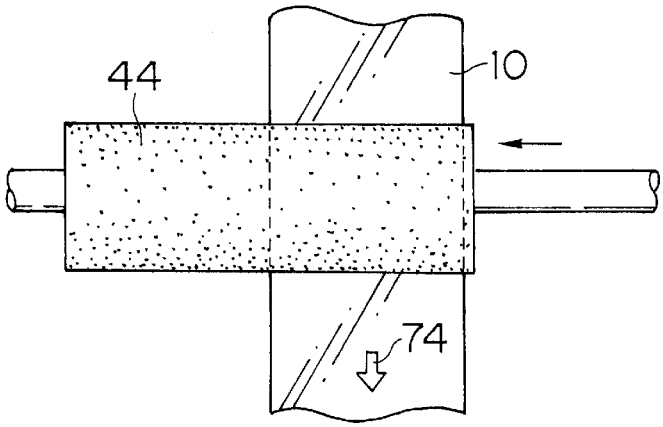
FIGS. 4(*a*) and 4(*b*) are views of assistance in explaining the operation of the surface treatment apparatus according to the present invention when the graining brush is moved in the width direction of a narrow aluminum web.
Figure 4:
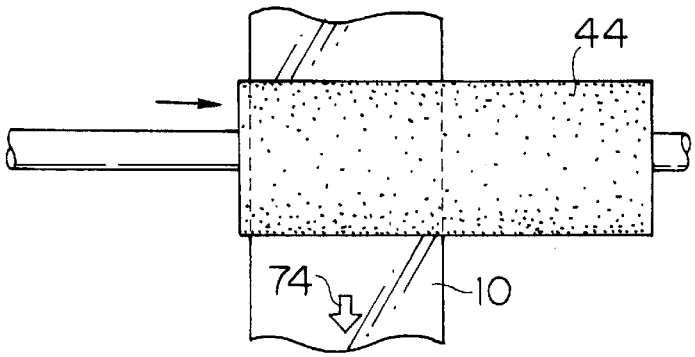

As shown in FIGS. 3(*a*) and 4(*a*), the controller 78 expands the piston rod 60 with the hydraulic pump 62 so that one end of the graining brush 44 can match with one end of the aluminum web 10. At this time, the piston rod 60 moves a longer distance in FIG. 4(*a*) than in FIG. 3(*a*). Then, as shown in FIGS. 3(*b*) and 4(*b*), the controller 78 contracts the piston rod 60 with the hydraulic pump 62 by the difference in width between the graining brush 44 and the aluminum web 10 so that the other end of the graining brush 44 can match with the other end of the aluminum web 10. Expanding and contracting the piston rod 60 to move the graining brush 44 periodically in the direction perpendicular to the transporting direction 74 causes the graining brush 44 to uniformly come into contact with the aluminum web 10. For this reason, when the graining brush 44 rubs the surface of the aluminum web 10 with the abrasive slurry 24 to grain the surface of the aluminum web 10, it is possible to equalize the abrasion of every bristle 52 of the graining brush 44.

Figure 5:
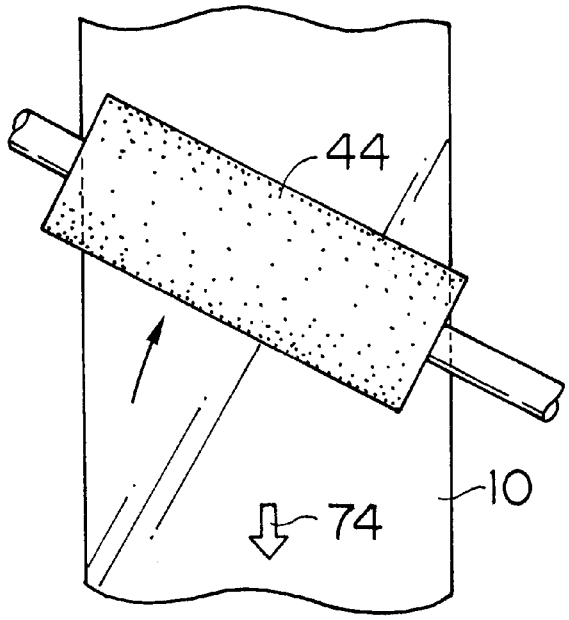
FIGS. 5(*a*) and 5(*b*) are views of assistance in explaining the operation of the surface treatment apparatus according to the present invention when the graining brush is placed obliquely against the transporting direction of the wide aluminum web.
Figure 5:
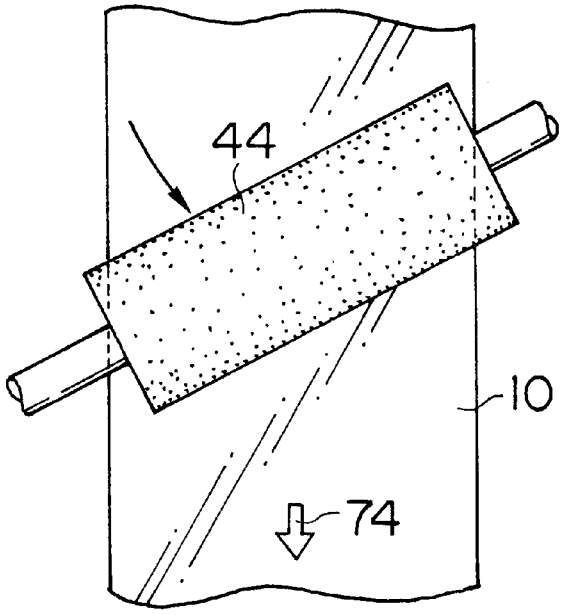
Figure 6:
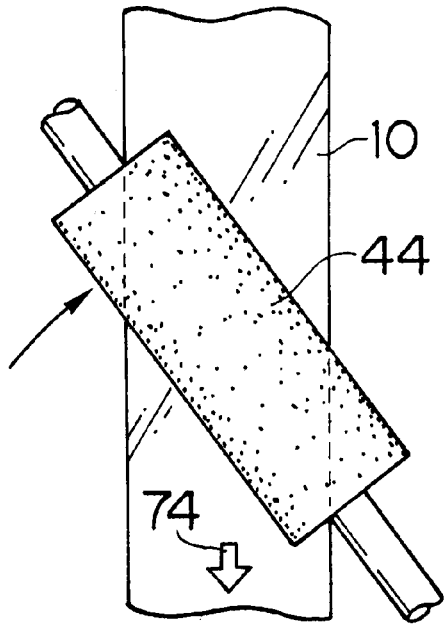
FIGS. 6(*a*) and 6(*b*) are views of assistance in explaining the operation of the surface treatment apparatus according to the present invention when the graining brush is placed obliquely against the transporting direction of the narrow aluminum web.
Figure 6:
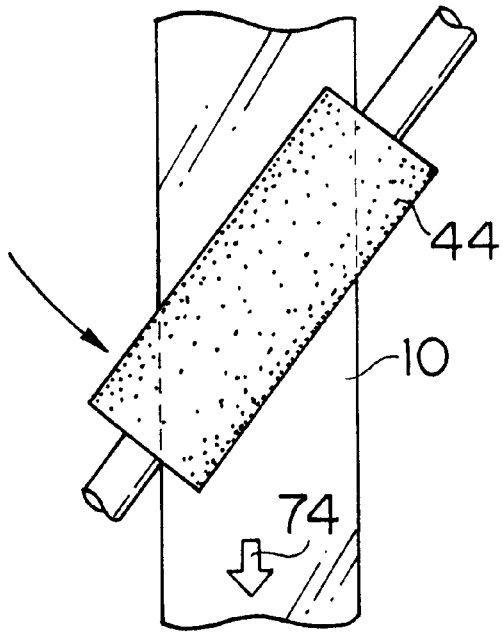

FIGS. 5(*a*) and 5(*b*) describe the case wherein the graining brush 44 is placed obliquely against the transporting direction 74 while treating the surface of the aluminum web 10 that is a little shorter in width than the graining brush 44. FIGS. 6(*a*) and 6(*b*) describe the case wherein the graining brush 44 is placed obliquely against the transporting direction 74 while treating the surface of the aluminum web 10 that is half of the graining brush 44 in width. In these cases, the controller 78 calculates the turning amount and conditions for placing the graining brush 44 obliquely against the transporting direction 74 in accordance with the determined values sent from the pair of sensors 76. The controller 78 actuates the rotational driving part 66 under the calculated conditions.

As shown in FIGS. 5(*a*) and 6(*a*), the turntable 64 is turned to turn the graining brush 44 from a position wherein the graining brush 44 is perpendicular to the transporting direction 74 to the upstream side in the transporting direction 74. The graining brush 44 is turned until both ends of the graining brush 44 matches with both ends of the aluminum web 10, and the rotational amount is larger in FIG. 6(*a*) than in FIG. 5(*a*). Placing the graining brush 44 obliquely against the transporting direction 74 causes the entire graining brush 44 to come into contact with the aluminum web 10. Thus, the entire graining brush 44 always comes into contact with the aluminum web 10 when the graining brush 44 rubs the surface of the aluminum web 10 with the abrasive slurry 24 to grain the surface of the aluminum web 10. It is therefore possible to equalize the abrasion of every bristle 52 of the graining brush 44.

If the graining brush 44 is turned to only one direction as stated above, it is not easy to make the corners of the graining brush 44 come into contact with the aluminum web 10. Therefore, after the graining brush 44 is turned to the upstream side of the transporting direction 74, the graining brush 44 is turned to the downstream side of the transporting direction 74 as shown in FIGS. 5(*b*) and FIG. 6(*b*). Consequently, the corners of the graining brush 44 uniformly comes into contact with the aluminum web 10.

In the above explanations, the graining brush 44 is moved periodically in the transporting direction 74, or the graining brush 44 is turned to be placed obliquely against the transporting direction 74. The present invention, however, is not restricted to this, and the above-mentioned movement and turn of the graining brush 44 may also be combined. In this case, the abrasion of every bristle 52 of the graining brush 44 may be equalized further.

According to the above-described surface treatment method and apparatus for the support of the lithographic plate, the abrasion in the bristles of the graining brush can be maintained uniform, when the graining brush rubs the surface of the support of the lithographic plate. For this reason, even if the surfaces of the plurality of supports with different widths are treated continuously, it is possible to reduce the number of times the graining brushes are replaced by new ones, and it is unnecessary to trim the bristles. Thus, the surface treatment can be efficient and economical.

In the above explanations, the graining brush 44 moves in the direction perpendicular to the transporting direction 74, but the aluminum web 10 may be moved widthwise with the graining brush being fixed. Moreover, the transporting direction of the aluminum web 10 may be turned with the graining brush being fixed.

EXAMPLE 1

In Example 1, a surface of an aluminum web was treated by the surface treatment apparatus in FIG. 1, which was provided with the brushing devices in FIG. 2. While the graining brushes rubbed the surface of the aluminum web, the abrasive slurry was poured onto the surface of the aluminum web. At the same time, the graining brushes were periodically moved in the direction of the width of the aluminum web. The movement amount of the graining brushes was equal to a difference in width between the aluminum web and the graining brushes, and the graining brushes were moved at a speed of 10 mm/min.

In a comparative example, the graining brushes were not moved at all with the central parts the graining brushes being in contact with the aluminum web.

In Example 1 and the comparative example, the graining brush is constructed in such a way that bundles of bristles of 30 mm long were fixed to a roller of 1,000 mm wide. First, the 800 mm wide aluminum web was transported by 100,000 m at a speed of 30 m/min. Then, the 300 mm wide aluminum web was transported by 100,000 m at a speed of 30 m/min.

With regard to Example 1 and the comparative example, the bristles at the central part of the graining brush and the bristles at both ends thereof were compared in length after the test. TABLE 1 shows the results.

TABLE 1

| | Length of bristles after test [mm] | |
|---|---|---|
| | Central part | Both ends |
| Example 1 | 18 | 19 |
| Comparative example | 12 | 30 |

As clearly shown in TABLE 1, with the use of the brushing device according to the present invention, it was possible to maintain the abrasion in the bristles of the graining brush uniform by moving the graining brush in the direction of the width of the aluminum web. In the case of Example 1, the graining brush was continuously used to treat the surface of next aluminum web.

In the comparative example, the bristles were abraded only at the central part of the graining brush, and the surface of the graining brush was uneven after the test. For this reason, it was necessary to replace the graining brush or trim the bristles.

EXAMPLE 2

In Example 2, a surface of an aluminum web was treated by the surface treatment apparatus in FIG. 1, which was provided with the brushing devices in FIG. 2. While the graining brushes rubbed the surface of the aluminum web, the abrasive slurry was poured onto the surface of the aluminum web. At the same time, the graining brushes were turned to be placed obliquely against the width direction of the aluminum web so that both ends of the graining brushes could correspond to both ends of the aluminum web.

In a comparative example, the graining brushes were not turned at all with the central parts of the graining brushes being in contact with the aluminum web.

In Example 2 and the comparative example, the graining brush is constructed in such a way that bundles of bristles of 30 mm long were fixed to a roller of 1,000 mm wide. First, the 800 mm wide aluminum web was transported by 100,000 m at a speed of 30 m/min. Then, the 300 mm wide aluminum web was transported by 100,000 m at a speed of 30 m/min.

With regard to Example 2 and the comparative example, the bristles at the central part of the graining brush and the bristles at both ends thereof were compared in length after the test. TABLE 2 shows the results.

TABLE 2

| | Length of bristles after test [mm] | |
|---|---|---|
| | Central part | Both ends |
| Example 2 | 20 | 21 |
| Comparative example | 12 | 30 |

As clearly shown in TABLE 2, with the use of the brushing device according to the present invention, it was possible to maintain the abrasion in the bristles of the graining brush uniform by turning the graining brush to place it obliquely against the width direction of the aluminum web. In the case of Example 2, the graining brush was continuously used to treat the surface of next aluminum web, In the comparative example, the bristles were abraded only at the central part of the graining brush, and the surface of the graining brush was uneven after the test. For this reason, it was necessary to replace the graining brush or trim the bristles.

As set forth hereinabove, the surface treatment method and apparatus for the support of the lithographic plate according to the present invention eliminates the disadvantages of the conventional brush graining method and apparatus, lowers the abrading speed of the graining brush and reduces the costs for changing the graining brushes. The number of times the graining brushes are changed is decreased dramatically, and the productivity is improved at low costs.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A surface treatment method for a support of a lithographic plate, wherein a graining brush rubs a surface of the support with abrasive slurry to thereby grain the surface of the support, the surface treatment method comprising at least one of the steps of:

moving at least one of the graining brush and the support periodically in a direction perpendicular to a transporting direction of the support, thereby making the entire graining brush uniformly come into contact with the support; and turning at least one of the graining brush and the transporting direction of the support such that the graining brush is placed obliquely against the transporting direction of the support, thereby making the entire graining brush come into contact with the support;

the surface treatment method further comprising at least one of the steps of:

if the at least one of the graining brush and the support is moved in the direction perpendicular to the transporting direction of the support, adjusting an amount of the movement in accordance with a width of the support; and if at least one of the graining brush and the transporting direction of the support is turned, adjusting an amount of the turning in accordance with the width of the support.

2. The surface treatment method as defined in claim 1 further comprising detecting a width of the support in the direction perpendicular to the transporting direction of the support.

3. A surface treatment apparatus for rubbing a surface of a support of a lithographic plate by a graining brush with abrasive slurry to thereby grain the surface of the support, the surface treatment apparatus comprising at least one of:

a moving device for moving the graining brush in a direction perpendicular to a transporting direction of the support;

a turning device for turning the graining brush such that the graining brush is placed obliquely against the transporting direction of the support, and such that the entire graining brush comes into contact with the support;

a detector for detecting a width of the support in the direction perpendicular to the transporting direction of the support; and a controller for controlling at least one of the moving device and the turning device based on the width of the support detected by the detector.

4. The surface treatment apparatus as defined in claim 3, wherein the graining brush comprises a body fixed on one of a roller and a plate, the body having a number of channels, the bristles being planted in the channels.

5. The surface treatment apparatus as defined in claim 3, wherein the graining brush comprises one of a roller and a plate, on which bundles of the bristles are directly fixed.

* * * * *